United States Patent [19]

Vasselli

[11] 4,325,549

[45] Apr. 20, 1982

[54] TENNIS RACKET WITH SELECTIVELY MOVABLE WEIGHT

[76] Inventor: Joseph P. Vasselli, 112 Battle Hill Ave., Springfield, N.J. 07081

[21] Appl. No.: 128,890

[22] Filed: Mar. 10, 1980

[51] Int. Cl.[3] ..... A63B 49/04

[52] U.S. Cl. ..... 273/73 R

[58] Field of Search ..... 273/67 R, 68, 72 R, 273/73 R, 73 C, 73 J, 80 A, 81 A, 170, 186 A, 194 B, 26 B, 29 A; 272/124, 128

[56] References Cited

U.S. PATENT DOCUMENTS

| | | | |
|---|---|---|---|
| 1,676,270 | 7/1928 | Mattison | 273/186 A |
| 2,451,217 | 10/1948 | Heinrich | 273/170 X |
| 3,931,968 | 1/1976 | Hedberg | 273/73 J X |
| 3,975,018 | 8/1976 | Walker | 273/73 R |
| 4,027,879 | 6/1977 | Wright | 273/29 A |

FOREIGN PATENT DOCUMENTS

| | | | |
|---|---|---|---|
| 407983 | 3/1934 | United Kingdom | 273/73 J |

*Primary Examiner*—Richard J. Apley

*Attorney, Agent, or Firm*—Ralph R. Roberts

[57] ABSTRACT

A tennis racket is shown with a movable weight and a latching device for release of the weight which is moved by the swinging of the racket to bring the weight to or near the head of the racket. An alternate construction shows a ball-type weight in each of the two guideways disposed adjacent to the handle, throat and frame of the racket. A power swing moves the balls into a more-or-less outward position. The movable weight or force is relatively easy to retain and release at the disposal or consent and discretion of the user of the racket.

3 Claims, 18 Drawing Figures

TENNIS RACKET WITH SELECTIVELY MOVABLE WEIGHT

BACKGROUND OF THE INVENTION

1. Field of the Invention

With reference to the field of art as established in and by the U.S. Patent Office, the present invention is believed to be found in the class entitled, "Amusement Devices," Games (Class 273) and in the subclass entitled, "Tennis Rackets" (Subclass 73R).

2. Description of the Prior Art

Conventional tennis rackets are based on a design established over many years. The frame of these rackets is conventionally of wood, metal of graphite composition. All these frames are lightweight for ease in manipulation by the user. They are individually selected so that a sufficient weight in the head is available for the striking of the ball with a controlled or predetermined force. A heavy racket with a heavy head, of course, has a capability of propelling the struck ball at a greater rate than a lighter racket. An increase in the weight in the head of a racket makes it more difficult to control and also is more fatiguing.

Weighted heads in tennis rackets are not new and the Professionals use lead tape to give added weight to the head of the racket. Just as the Professionals and advanced amateurs vary the tension of the strings they change weights in the head for different court conditions. The present invention enables the occasional tennis buff to change the weight to suit playing conditions and to accommodate muscle tone or training. Movable weight apparatus utilizing springs is shown in prior art patents for tennis rackets but a sliding weight as in the embodiments to be described are believed to be novel and practical.

In the present invention the increased force provided by a weighted head is achieved by a sliding or shifting weight that is easily controlled by the user of the racket. When a greater weight is desired in the head and a greater force is to be applied to the ball a heavier weight is slidably mounted in the head to provide an increase in the propulsive force. The present invention proposes to retain the weight which is carried in or near the handle when the racket is used for strokes that do not require or desire a large or optimum propulsive force.

A number of prior art devices such as the racket shown in U.S. Pat. No. 3,975,018 to WALKER, issued on Aug. 8, 1975 and also baseball bats, golf clubs and the like have employed movable weights for the shifting of the center of gravity. None of these prior art devices have employed means for restraining the movement of the weight outwardly by the use of inhibiting or latching means. In this invention the weight in or near the handle is released to allow said weight to be moved outwardly toward the head to increase the head weight of the racket.

SUMMARY OF THE INVENTION

This invention may be summarized, at least in part, with reference to its objects. It is an object of this invention to provide a new and improved racket wherein a movable weight or weights may be controlled by a latch or delayed by a button control.

It is a further object of this invention to provide a tennis racket of conventional design in which is provided a central guideway within which a weight of a selected amount is provided.

It is another object of this invention to provide a tennis racket in which there is provided a hollow guideway within which a sliding weight is movable. Each end of this tube has a vent in order to allow free movement of the weight within the tube.

In brief, this invention discloses several embodiments in which the weight is carried in or near the handle and at a determined or selected time is released by a controlled actuation by the user of the racket to allow the weight to be moved outwardly towards and to the head of the racket.

A preferred embodiment includes a tube guideway which extends through the handle and up the throat of the racket. A weight, which is preferably covered by means providing a noiseless actuation, is freely slidable in this tube. The upper and lower ends of the tube may have a noise absorbing means, such absorbing means may be carried by and on the ends of the weight. An inhibition to the free movement of weight is prevented by vents which are provided in the upper and lower portions of this tubular guideway. A stop to movement of said weight may be by a button or lever which is actuated to restrain the motion of the weight outwardly. In another embodiment the weight may be a magnet with North and South magnetic poles. Another magnet may be used to repel the weight when it is moved towards the throat end of the racket and a like magnet may be placed in or near the handle of the racket to attract the weight and restrain unwanted movement. An alternate means shows a weight freely slidable in a tube mounted between the handle and throat. This weight and tube may be an add-on assembly.

An alternate embodiment includes a weight that may be carried on a rod. When the frame is metal this rod allows the weight to freely slide therealong. On existing wood frame rackets there is also contemplated a fixing of one or two guideways in which balls may be carried. These guideways are bendable and may extend up the outer sides of the racket to the midportion thereof. A ball is freely movable in each of these guideways and inhibiting forces to retain the balls in the desired handle position may be provided. The weight carried in the racket may also be a ball with or without the use of a vent.

In the several embodiments whether as an alteration to an existing racket, a new racket with a slidable weight capability or as an add-on the selectability of the weight as to its amount and release is novel. The add-on concept permits the owner to try out this selectively movable weight without alteration of the basic racket. The amount of weight supplied can be varied as to the user. The latch or lever stop is usually positioned on or at one of the diagonal surfaces of the racket handle.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen specific embodiments of a tennis racket with a selectively movable weight as adopted for use and training of tennis power strokes and showing a preferred means for mounting and altering a frame. This specific embodiment and alternates have been chosen for the purposes of illustration and description as shown in the accompanying drawings wherein:

BRIEF DESCRIPTION OF THE DRAWINGS

FIG. 12 represents a diagrammatic side view of a metal frame racket in which a tube is carried between the handle and throat and may be considered an add-on;

FIG. 15 represents a cross sectional view, partly diagrammatic, and showing a clamp means for a tube add-on and the racket frame is constructed of wood or the like;

In the following description and in the claims various details are identified by specific names for convenience. These names are intended to be generic in their application. Corresponding reference characters refer to like members throughout the several figures of the drawings.

The drawings accompanying, and forming part of, this specification disclose details of construction for the purpose of explanation but structural details may be modified without departure from the concept and principles of the invention and the invention may be incorporated in other structural forms than shown.

DESCRIPTION OF THE PREFERRED EMBODIMENTS

Figure 1:
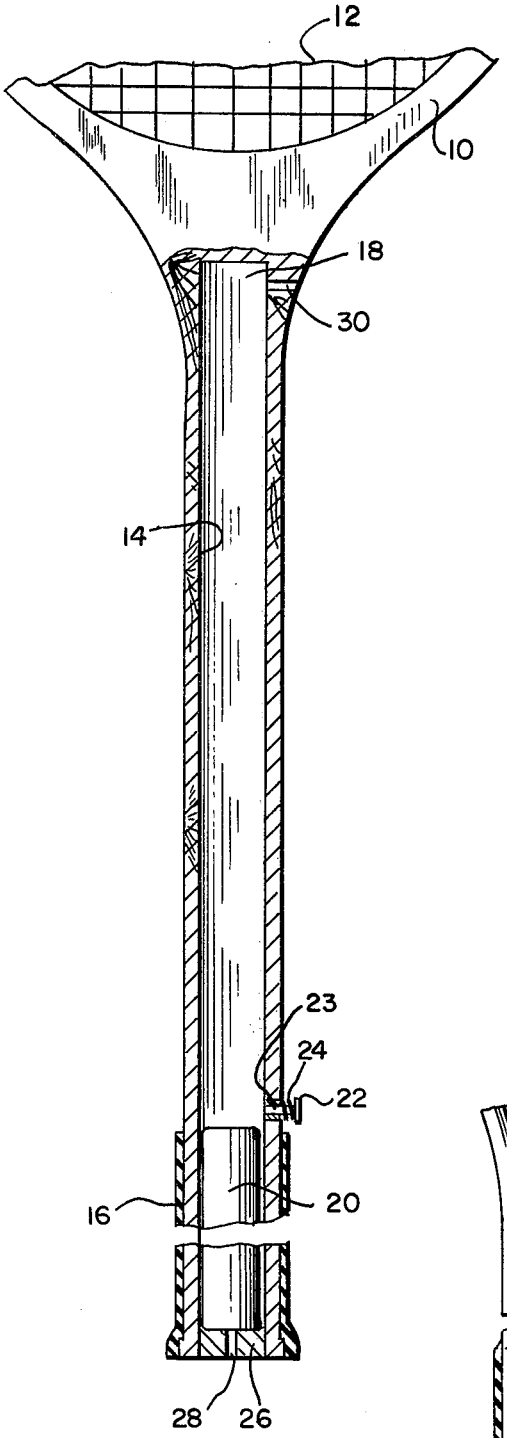
FIG. 1 represents a diagrammatic plan or face view of a typical tennis racket shown partly in section and illustrating one embodiment in which a weight is slidably movable in a tubular guideway.

Racket Construction of FIG. 1

Referring now and next to the drawings and the embodiments shown, it is to be noted that FIG. 1 depicts the preferred construction of a weight movable within a racket. This racket has a head portion 10 with a string arrangement 12 which is conventional. A linear guideway 14 is formed in the racket between a handle portion 16 and throat 18. This guideway is a tubular portion which may be a metal tube or may be a drilled passageway in the racket. A weight 20 is freely movable in this guideway 14 and as reduced to practice is covered by cloth or plastic so that a sudden stop, such as occurs when the weight reaches the throat end of the passageway, is made more-or-less noiseless. In FIG. 1 there is shown a delay button or trigger 22. This button is shown as spring actuated by a small compression spring 24 which is at the upper end of the handle portion 16. A closure 26 at the handle end of the guideway 14 has a vent hole 28 therethrough. A like vent hole 30 is provided at the throat end of the guideway.

Use and Operation of the Racket of FIG. 1

The racket of FIG. 1 anticipates the weight 20 is a freely sliding fit in the guideway 14. The total amount of weight 20 is selected by the user of the racket. The button 22 is directed inwardly so that a stem 23 inhibits the outward movement of the weight as the racket is swung for a return stroke or volley. The button is released when an increased weight in and at the head of the racket is desired. The swing and the release of the weight 20 enables said weight to travel in and along the guideway 14 to the head of the racket. The vent 30 in the head allows the weight to travel swiftly along the guideway without air pressure buildup. In a like manner the vent 28 allows the weight 20 to freely travel toward and to the handle end of the guideway. The end closure 26 is so positioned that the weight 20 is trapped between the end closure and the button. It is often not desirable for the weight to be at the head for short swings so weight retention is desirable at that time.

Figure 2:
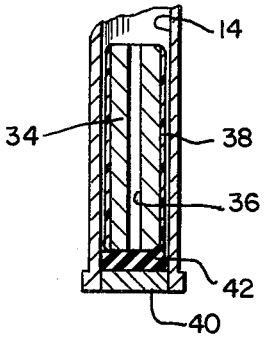
FIG. 2 represents a fragmentary sectional plan view of a handle portion of a racket in which the sliding weight has its longitudinal exterior covered with plastic and has a through aperture which prevents air pressure actuation which may slow down the movement of the weight.

Alternate Weight Construction of FIG. 2

Referring next to FIG. 2 there is shown an alternate weight and a cover of the weight than that shown in FIG. 1. As seen in FIG. 2 a weight 34 is formed with an aperture 36 therethrough. An outer sleeve 38 is of plastic and has sliding properties such as in TEFLON (TM duPont). A guideway 14 includes at its lower end a closure member 40 which includes a resilient pad or disk 42. There is no vent needed in the lower and upper ends of the guideway. The weight 34 may have the outer sleeve covering 38 brought to and around each end of the weight so that sound deadening means of pad 42 is not required.

Figure 3:
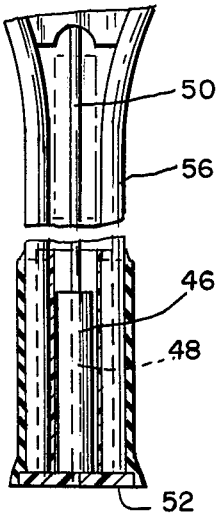
FIG. 3 represents a fragmentary plan view of a metal frame and showing the weight slidable on a wire or rod.
Figure 4:
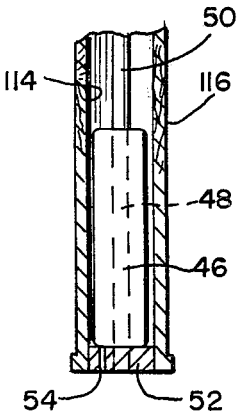
FIG. 4 represents the plan view of FIG. 3 but with the weight and rod disposed in a wood frame.

Alternate Weight Arrangement as in FIGS. 3 and 4

Referring next to FIGS. 3 and 4 there is depicted a weight 46 which has a through aperture 48 much like that in FIG. 2. This weight is slidable on a rod or wire 50. If and when the handle portion 16 is bored or drilled to accept the seating of the weight 46 there is a stop 52 which may have a vent 54 when the bore is a close fit. When a larger bore is provided a vent is not necessary. Where the weight is to be used in a metal frame racket 56 as in FIG. 3 the upper end of the rod or wire 50 is secured at the throat of the frame 56. Where a wood frame 116 is provided a linear guideway 114 is provided and if the weight is a close fit vents are provided at both ends of the guideway. A button stop similar to that shown in FIG. 1 may also be provided.

Figure 5:
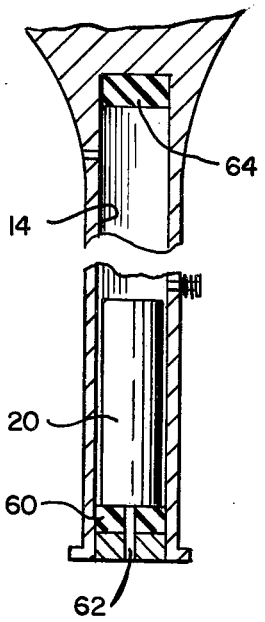
FIG. 5 represents a fragmentary sectional view of a racket handle with cushioning stops at each end of the tubular guideway.

Sound Deadening Means as in FIG. 5

In FIG. 5 there is shown a linear guideway 14 within which the weight 20 moves to the ends thereof. A sponge rubber cushion 60 with an aperture or vent 62 therethrough is disposed at the lower or handle end of the guideway. The upper or throat end is also provided with a sponge rubber cushion 64. Although sponge rubber is mentioned that does not preclude the use of foam plastic, fabric and soft rubber or rubber-like material. In certain training applications it may be desirable that the cushioning be removed to provide a sound indicator of the weight shift. After the training period the cushioning is replaced in the racket.

Figure 6:
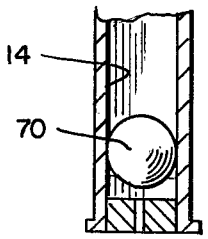
FIG. 6 represents a fragmentary sectional plan view of a racket handle in which the movable weight is substantially spherical in configuration.

Ball-Shaped Weight of FIG. 6

In FIG. 6 there is shown a ball-shaped weight 70 which is freely movable in a linear guideway 14, above described. This ball-shaped weight may be of metal, metal with a plastic or cloth cover or may be rubber or a rubber-like material. When the ball is of a slidable diameter the guideway 14 is supplied with vents 28 and 30 as in FIG. 1. When the ball is of rubber or a rubber-like cover it is contemplated that a Durometer of less than forty will cause the ball to bulge and minimize noise and vibration at the end of its travel.

Figure 7:
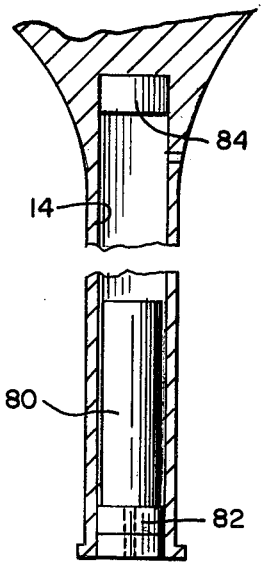
FIG. 7 represents a fragmentary sectional view of a racket handle in which the sliding weight is a magnet and there is disposed at each end of the guideway a magnet having polarity adapted to attract or repel the the slidable magnetic weight.

Magnetized Weight as in FIG. 7

As shown in FIG. 7 there is shown a magnetic weight 80 which is a magnet with North and South poles. As depicted, at the handle end of the guideway 14 there is a permanent magnet 82 also with North and South polarity. This disk-like magnet is arranged so as to provide a determined attraction for the magnetic weight 80. At the other or throat end of the guideway 14 there is another disk-like magnet 84 which is arranged to repel the magnetic weight 80. Vents at each end of the guideway insure free movement of the weight 80 in and along said guideway.

Figure 8:
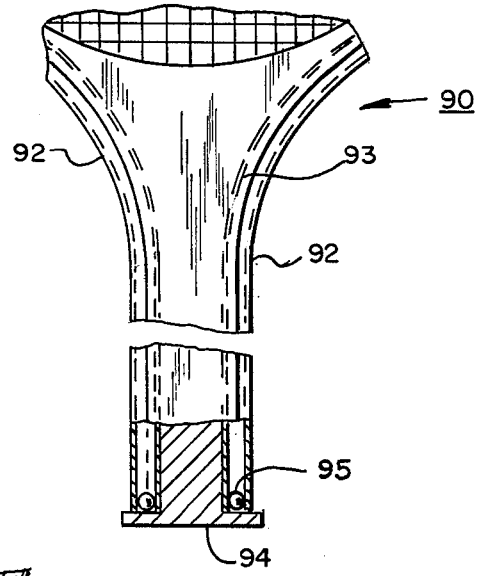
FIG. 8 represents a side view, partly in section and diagrammatic, and showing an add-on arrangement whereby two ball-type weights are movable in tubular passageways attached to the outer surfaces of the racket.

Attached Weight Guides and Weights of FIG. 8

Referring next to FIG. 8 there is depicted a racket 90 of either wood or metal construction having flexible guideways or tubes 92 attached to the outer surfaces of the racket. These tubes 92 are glued or otherwise attached to the sides of the racket frame 93 and at the lower end to the top portion near the handle 94. The upper ends of the tubes 92 are arranged along the lower side portions of the racket frame 93. Ball-type weights 96 are movable in these tubular flexible guideways 92 and button or like control of the movement of the balls in the guideways is, of course, contemplated. Vents are provided to insure free movement of the balls in the tubular guideway.

Figure 9:
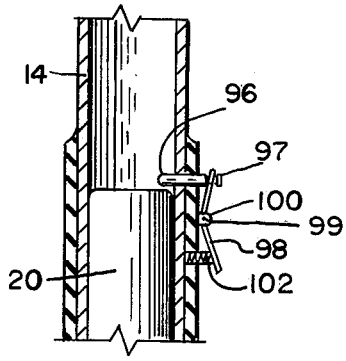
FIG. 9 represents a fragmentary side sectional view of a racket handle in which the sliding weight is restrained by a pin latch means in which the latch is pivoted at its midlength.

Latch Means as in FIG. 9

Referring next to the fragmentary view as in FIG. 9, there is depicted a tubular passageway 14 in and through which a weight 20 may travel. A pin 96 is pivotally secured at its outer end by a pivot 97 to a lever 98. This lever is pivotally secured at its midlength by a hinge pin 99 to a hinge support 100. A spring 102 is shown but a resilient member may also be provided. The pin 96 and the end of the lever 98 have a determined amount of free play to allow the lever to swing in a short arc. This pin 96 as hinged by spring 102 is normally in a weight restraining condition and thumb or finger manipulation is needed to release the weight 20 from its handle seating position or condition.

Figure 10:
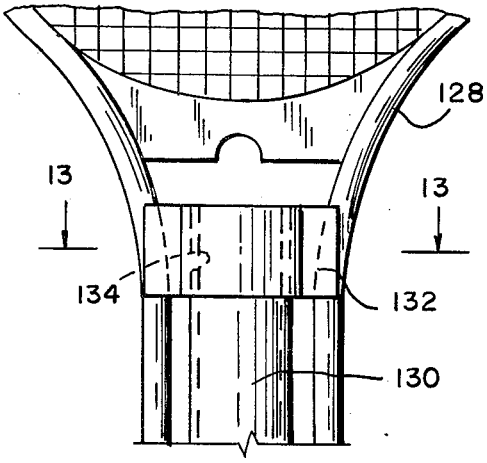
FIG. 10 represents a fragmentary side sectional view of a racket handle in which the sliding weight is restrained by a similarly pivoted latch means as seen in FIG. 9 in which the restraining member is a magnet held at the distal end of the latch.
Figure 10:
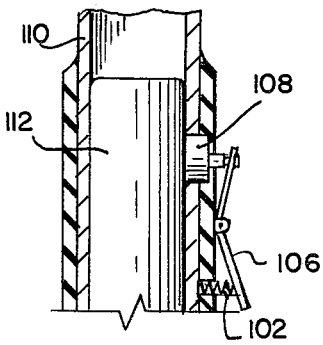

Latch Means as in FIG. 10

The fragmentary side view of FIG. 10 shows a lever 106 which is much like that shown in FIG. 9 above. This lever 106 is pivotally disposed and is moved by a spring or resilient means to the actuated condition as shown. Spring 102 is depicted and instead of pin 96 there is provided a magnet 108. Tube 110 is nonmagnetic but weight 12 is ferrous and thus is magnetically attracted. In operation the magnet 108, carried by the lever 106, is urged by the bias means against the tube 110 and when the weight 112 is brought along side the magnet 108, the weight is restrained from moving in the tube. The actuation of the lever 106 to cause the magnet to move away from tube 110 frees the weight 112 and allows it, the weight, to move outwardly in the tube 110.

Figure 11:
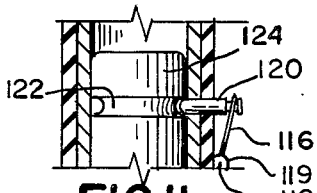
FIG. 11 represents a fragmentary side sectional view of a racket handle like FIG. 9 but with the pin end entering a groove in the weight.

Latch Means as in FIG. 11

The latch of FIG. 11 is like those in FIGS. 9 and 10, in that the latch is moved by a lever. The restraining apparatus of FIG. 11 includes a lever 116 which is pivotally carried at its midlength by a hinge pin 118 and hinge retainers 119. A pin 120, which is like or similar to pin 96 in FIG. 9, extends through linear guideway 14 and instead of engaging the end of a weight, enters a circumferential groove 122 formed in weight 124. A spring 102 or bias means is adapted to engage said lever to move the pin 120 inwardly unless moved by a thumb or fore finger.

It is to be noted that the latch means of FIGS. 9, 10, and 11 is adapted for a lever actuation with the lever having biasing means for urging the upper end of the lever towards the tube. In each of the above examples the lower end of the lever is disposed to be pressed against the bias when the weight is to be released. Said lever is often disposed at the bevel or diagonal edge of the handle.

Figure 12:
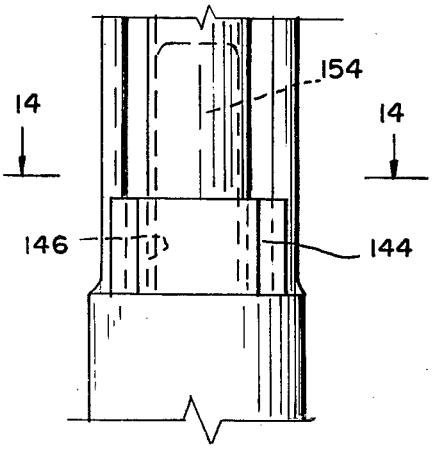
Figure 13:
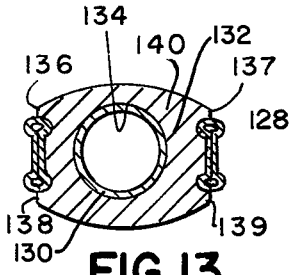
FIG. 13 represents a cross sectional view of a clamp or holding member, this view taken on the line 13—13 of FIG. 12 and looking in the direction of the arrows.
Figure 14:
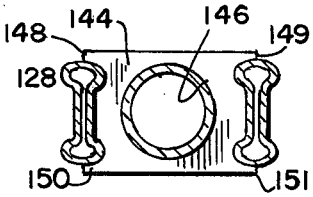
FIG. 14 represents a cross sectional view of another clamp or holding member for the same tube, this view taken on the line 14—14 on FIG. 12 and looking in the direction of the arrows.

Add-on Weight Guide as in FIG. 12, 13, and 14

There is shown in FIGS. 12, 13 and 14 an add-on weight controlled apparatus. In certain instances and particularly when and where the user of the racket desires to experiment with a sliding weight but is not ready for a permanent change, there is provided an add-on apparatus. In FIG. 12 there is assumed the use of a metal frame 128 on the racket. Without alteration of said frame a short length of tubing, metal or plastic and identified as 130 is secured at its upper end by a partially resilient retainer 132. This retainer has a passageway or bore 134 within which the tube 130 is securely mounted. This tube length is a slidable force fit in said hole 134.

This upper retainer 132 (FIG. 13) is formed generally as an "I" beam with two extending flange portions disposed to engage each portion of the frame. These extending wing portions are identified as 136, 137, 138 and 139. The connecting bar portion 140 has the passageway or bore 134 therethrough. The lower end of this tube 130 is retained by a retainer 144 (FIG. 14). This retainer also has a hole 146 which, like passageway or bore 134, is a tight but slidable fit on tube 130. As with the upper retainer, this lower retainer is of a partially resilient material. This retainer as seen in section in FIG. 14 is generally "I" beam shaped but does not have as great extending wing portions in the formation of the retainer. These wing portions are identified as 148, 149, 150 and 151. Not shown is a lever apparatus which is carried by this lower retainer 144. Weight 154 is controlled by one of the lever devices as shown in FIGS. 9, 10 or 11.

Figure 15:
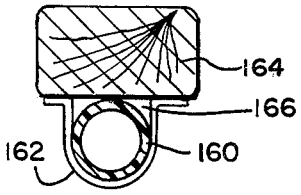

Add-On Apparatus as in FIG. 15

Referring next to FIG. 15 there is diagrammatically shown in a cross-sectional view, an add-on apparatus for use with a wood-frame racket. A plastic or like holding form may be an extrusion which is metal or plastic. A tube 160 is provided and, as shown, said tube 160 is secured in an extrusion 162 which may have an adhesive by and with which it is attached to a wood racket frame 164. The extrusion may or may not have a fill portion 166. A latch and weight much like or identical with those in FIGS. 9, 10 and 11 may be used with this add-on.

Figure 16:
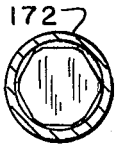
FIG. 16 represents a sectional view partly diagrammatic, and showing a hexagonal shaped weight slidable in a round tube.

Embodiment of FIG. 16

Referring to FIG. 16 there is depicted a weight 170 which is shown with a hex configuration. The corners of said weight are rounded or smoothed for ease in sliding within a tube 172. This shape association eliminates the need for a vent at the ends of the tube.

Figure 17:
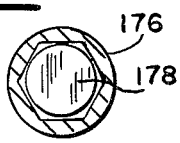
FIG. 17 represents a sectional view, partly diagrammatic, and showing a round weight slidably in a hexagonal tube.

Embodiment of FIG. 17

FIG. 17 shows a referse configuration of the tube and weight of FIG. 16. As depicted there is a hexagonal tube 176 within which a round or cylindrical weight 178 is slidable. In both FIGS. 16 and 17 it is to be noted that the weight and tube need only to provide a bypass to prevent an air buildup with a slidable weight. A flat or a groove on the weight may also be provided. Hex shapes are shown but are selected only to exemplify the possibilities of selection.

Figure 18:
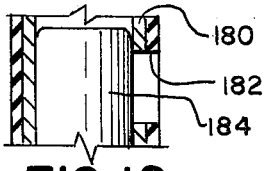
FIG. 18 represents a very fragmentary side view and showing diagrammatically a slot in the lower end of the tube, this slot disposed to allow a finger or thumb of a user to enter the slot sufficiently to engage the slidable weight and inhibit movement of the weight until release.

Embodiment of FIG. 18

Referring next and finally to FIG. 18 it is to be noted that the use of latches such as in FIGS. 9, 10 and 11 and in the button stop of FIG. 5 may be omitted in the stop means of this FIG. 18. A tube 180 has a slot 182 formed in a side thereof. A weight 184 is slidable in this tube and through this slot 182 the finger or thumb of the user extends to engage a side of the weight until the weight is to be released.

Use and Operation

The racket to be altered or modified may be made as an originally manufactured unit. The weight is freely movable in a selected guideway and inhibiting means are provided to prevent unwanted movement of the weight until a power stroke or swing is to be made. The movable weight enables the user of the tennis racket to selectively increase the force with a determined swing. The weight increase is a matter of choice and is made to suit the user of the racket. It is desirable to make the movement of the weight more-or-less noiseless and the use of vents to insure free movement is often essential. Air pressure retardation, in particular, is not desired. The tennis racket frame may be wood, metal or the new graphite frame. The button may be a simple spring actuated plunger pin, a deflection of a tube, a biased lever, a resilient plug or any conventional stop means. It is very essential that the weight move freely to the outer limit when released.

Several embodiments have shown and suggested the making of the tennis racket frame and handle as an original equipment option. Whether a ball is used as in FIGS. 6 and 8, or a cylindrical structure as in the other embodiments, it is desirable that the weight amount is selected so as not to tire him or her. The user of the racket can increase or decrease the amount of weight to suit his or her game. The use of magnets as in FIG. 7 allows the weight to be retained in the handle until a certain swinging force is achieved. The repulsion of the magnet weight at the head end of the guideway assists in the return of the weight to the handle.

Gravity is, of course, used to return the sliding weight to the handle area. The rubber or rubber-covered ball of FIG. 6 is contemplated to have sufficient resiliency to minimize noise and vibration. The button 22 and stem 23 are suggested as an inexpensive weight movement control but resilient plugs and other latching apparatus as in FIGS. 9, 10 and 11 are used to retain the weight except when released is also contemplated. A manual control of the weight movement is desirable but automatic control is provided in FIG. 7.

In the description of many of the above embodiments the weight is round or is cylindrical in configuration. As above noted and in FIGS. 16 and 17 the use of a hex or octagonal weight or tube is also noted. The use of a single flat or groove in the weight has not been shown but is an obvious alternate.

The add-on apparatus, above shown and described, is contemplated to be a card item sized to fit specific rackets. The weights are varied so that the amount may be increased or decreased at the choosing of the user. The retainers depicted in FIGS. 13 and 14 may be of rubber or plastic but they are sufficiently resilient to permit a tight fit in a frame of the racket while gripping the tube. The weight and tube may be used as a training device without latching means. As a training device the sliding weight, with appropriate noise indication or signal, indicates a proper or desired swing of the racket.

Terms such as "left", "right", "up", "down", "bottom", "top", "front", "back", and the like are applicable to the embodiments shown and described in conjunction with the drawings. These terms are merely for the purposes of description and do not necessarily apply to the position in which the tennis racket may be constructed or used. While particular embodiments of the racket frame and a movable weight have been shown and described, it is to be understood the invention is not limited thereto since modifications may be made within the scope of the accompanying claims and protection is sought to the broadest extent the prior art allows.

What is claimed is:

1. An improved tennis racket having a weight which is selectively movable toward and to the head of the racket to increase a force for driving and/or returning a ball, said tennis racket including:

(a) a head portion including stretched strings supported and secured thereto;

(b) a throat portion, adjacent said head portion, merging into a handle portion, said handle portion terminating in a handle;

(c) a tubular passageway extending substantially centrally of said throat portion, said handle portion and said handle;

(d) a weight located in said tubular passageway, said weight being normally freely slidable throughout said tubular passageway and with each end of said tubular passageway having a closure to limit the travel of said weight;

(e) vent means operatively associated with said tubular passageway to prevent air cushioning and slowing of the movement of the weight in said tubular passageway; and (f) weight stop means located adjacent the upper end of said handle and being exposed on the outer surface of said handle portion for selective engagement by the racket user, said stop means being normally out of engagement with said weight so as to permit said weight to be freely slidable in said passageway, said stop means including means for engaging said weight within said passageway upon the user pressing inwardly on said stop means so as to temporarily restrict movement of said weight.

2. An improved tennis racket as in claim 1 in which the weight stop means is a button connected to an inwardly directed stem portion, said stem portion entering said passageway to engage the weight when the button is pressed inwardly against a bias.

3. An improved tennis racket as in claim 2 in which the bias for moving the button and stem portion outwardly is a compression spring.

* * * * *